US009446528B1

(12) United States Patent
Zahorski

(10) Patent No.: US 9,446,528 B1
(45) Date of Patent: Sep. 20, 2016

(54) RING WITH CUTTING BLADE

(71) Applicant: Vance P Zahorski, Pflugerville, TX (US)

(72) Inventor: Vance P Zahorski, Pflugerville, TX (US)

( * ) Notice: Subject to any disclaimer, the term of this patent is extended or adjusted under 35 U.S.C. 154(b) by 7 days.

(21) Appl. No.: 14/676,541

(22) Filed: Apr. 1, 2015

Related U.S. Application Data

(60) Provisional application No. 61/973,621, filed on Apr. 1, 2014.

(51) Int. Cl.
*B26B 27/00* (2006.01)

(52) U.S. Cl.
CPC ..... *B26B 27/007* (2013.01)

(58) Field of Classification Search
CPC .. B26B 27/007; B26B 21/527; Y10T 16/476
See application file for complete search history.

(56) References Cited

U.S. PATENT DOCUMENTS 611,313 A * 9/1898 Crandall ..... B26B 27/007 30/291
647,862 A * 4/1900 McLaughlin ..... B26B 27/007 30/291
1,060,773 A * 5/1913 Litzman ..... B26B 27/007 30/291
1,165,697 A 12/1915 Morrell
1,379,864 A * 5/1921 Alton ..... B26B 27/007 30/291
1,497,077 A * 6/1924 Freeman ..... B26B 27/007 30/291
1,521,051 A * 12/1924 Shiba ..... B26B 27/007 30/291
2,707,828 A 5/1955 Stewart
4,896,422 A 1/1990 Sheehan et al.
5,038,479 A * 8/1991 Davis ..... B26B 27/007 30/113.1
5,301,432 A * 4/1994 Richardson ..... B26B 27/007 30/291
5,385,569 A * 1/1995 Swor ..... A61B 17/0467 451/526
6,018,877 A * 2/2000 Greene ..... B26B 21/222 30/298
6,029,387 A 2/2000 Swor
2002/0124417 A1 9/2002 De La Cruz
2006/0060040 A1 3/2006 Wichner
2010/0050690 A1 3/2010 Woodward
2010/0299941 A1 12/2010 Marlin
2013/0031935 A1 2/2013 Kelleghan

FOREIGN PATENT DOCUMENTS

DE 102006023334 B4 4/2008

* cited by examiner

*Primary Examiner* — Hwei C Payer
(74) *Attorney, Agent, or Firm* — Thomas W. Galvani, P.C.; Thomas W. Galvani

(57) ABSTRACT

A ring includes a ring body having a shoulder, a neck extending from the shoulder, and a cap extending from the neck and spaced apart from the shoulder, thereby defining a gap between the cap and the shoulder. A blade is mounted in both the cap and neck, and the blade has a curved edge extending from the head to the shoulder and into the gap.

12 Claims, 5 Drawing Sheets

RING WITH CUTTING BLADE

CROSS-REFERENCE TO RELATED APPLICATIONS

This application claims the benefit of U.S. Provisional Application No. 61/973,621, filed Apr. 1, 2014, which is hereby incorporated by reference.

FIELD OF THE INVENTION

The present invention relates generally to jewelry, and more particularly to sporting goods jewelry.

BACKGROUND OF THE INVENTION

Fishermen often carry a number of tools with them when they fish. For instance, a fisherman may carry a tackle box or a vest carrying a wide variety of flies, hooks, and other devices to be attached to a line. The fisherman might have a small guidebook describing the creek, lake, or other water which he is fishing, or the type of lure and line to be used for a fish feeding in a certain location. The fisherman will likely also carry a variety of lines with him, because he may use numerous lines of varying weights while fishing. In sum, the fisherman carries a great deal of gear. The fisherman often keeps all his gear together so that none of it is forgotten or lost, but keeping and storing it together reduces its portability and is cumbersome.

In addition to all his other gear, the fisherman typically also carries at least one knife. A knife is useful in a wide variety of expected and unexpected ways. Frequently, though, a knife is used to cut line, perhaps because the line is tangled, or about to be tied to a leader or tippet, needs to be freed of a hook, or for other reasons. The fisherman is thus frequently pulling his knife out, unsheathing or flipping the blade open, cutting the line, and stowing the blade safely. When the fisherman uses his knife frequently, despite the best of intentions, he can grow cavalier with the knife and it can pose a severe danger to himself and others. Further, if the fisherman needs the immediate ability to cut the line without hesitation, he may not have time to reach to his knife and open or unsheathe it. Still further, if the fisherman forgets his knife, he has to resort to especially crude methods for cutting the line, such as using his teeth or a rock, if cutting the line is at all possible. An improved device for cutting fishing line is needed which can be carried with a fisherman and not forgotten.

SUMMARY OF THE INVENTION

A ring includes a ring body having a shoulder, a neck extending from the shoulder, and a cap extending from the neck and spaced apart from the shoulder. A gap is thereby defined between the cap and the shoulder. A blade is mounted in the cap and in the neck, and the blade has a curved edge extending from the cap to the shoulder and into the gap, where the blade is exposed for cutting.

BRIEF DESCRIPTION OF THE DRAWINGS

Referring to the drawings.

DETAILED DESCRIPTION

Figure 1:
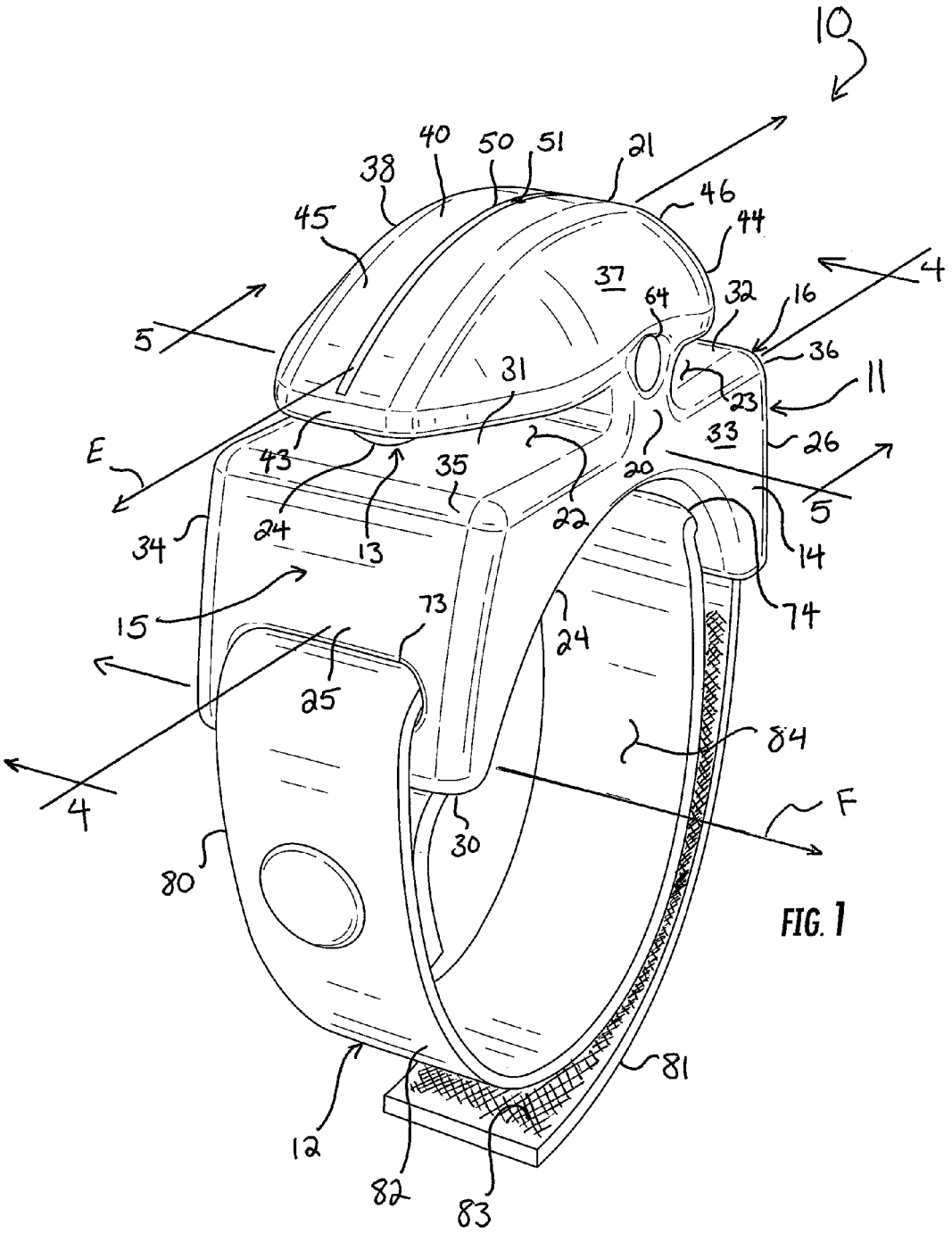
FIG. 1 is a top perspective view of a ring including a body, a strap, and a blade set into the body.

Reference now is made to the drawings, in which the same reference characters are used throughout the different figures to designate the same elements. FIG. 1 illustrates a top perspective view of a ring 10 with a cutting blade useful especially for fishermen. The ring 10 includes a rigid body 11, an adjustable strap 12, and a blade 13 contained within the body 11 for cutting items such as fishing line. The ring 10 is adjustable to be fit onto and worn securely on fingers of any size, so that the fishermen can pull a line taut against blade 13 and slice the line with the blade 13.

The body 11 of the ring 10 includes a generally semi-annular base 14 having two opposed shoulders 15 and 16, a neck 20 extending upwardly from the base 14 between the shoulders 15 and 16, and a cap 21 formed to the neck 20. The cap 21 is spaced apart from the base 14 by the neck to define gaps 22 and 23 in which a blade 24 is exposed. The body 11 of the ring 10 is formed of a material or combination of materials having rigid, hard, and durable material characteristics, such as steel, titanium, plastic, or the like.

Figure 2:
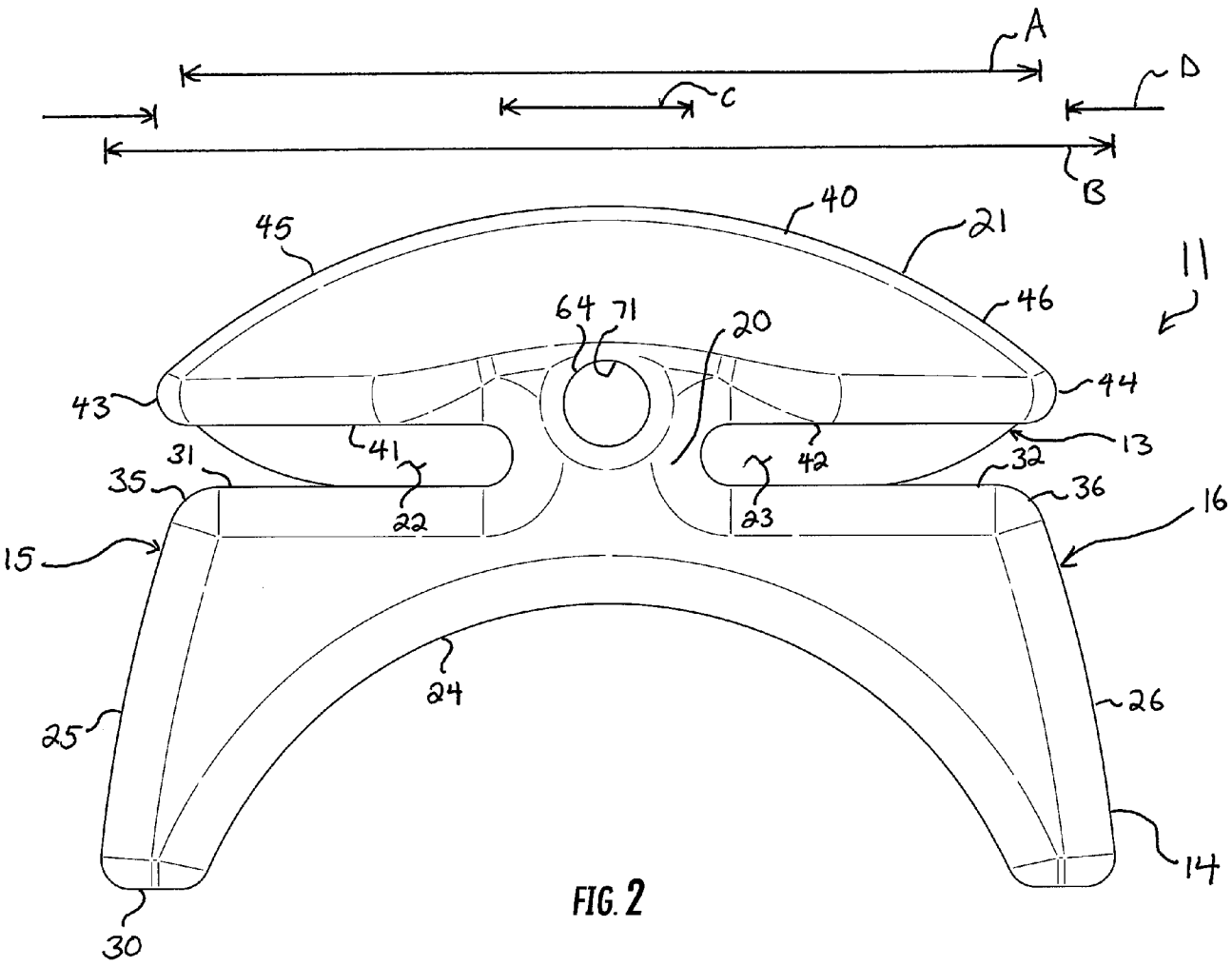
FIG. 2 is side elevation view of the body and blade of the ring of FIG. 1 in isolation without the strap.
Figure 3:
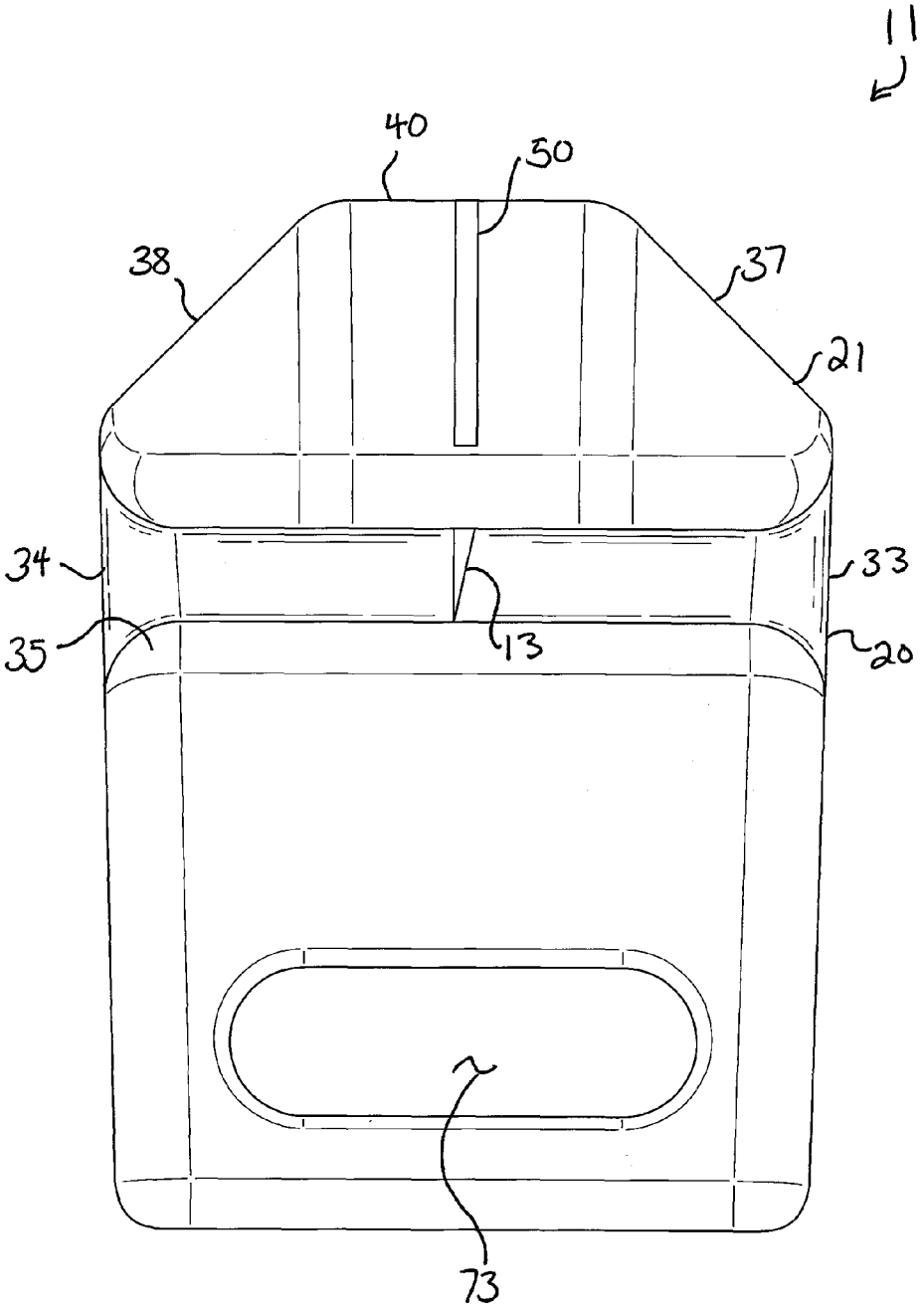
FIG. 3 is a front elevation view of the body and blade of the ring of FIG. 1 in isolation without the strap.

The body 11 of the ring 10 has an arcuate underside 24 defining a contact face for the ring 10 to be worn on a finger. The body 11 has opposed ends 25 and 26 which extend from a lower end 30 of the body 11 upward to decks 31 and 32, respectively, of the body 11. The ends 25 and 26 are curved slightly inwardly and upwardly, as is best seen in FIG. 2, from the lower end 30 to the decks 31 and 32, respectively. The body 11 further includes opposed sides 33 and 34 which extend across the entire body 11 between the ends 25 and 26. The sides 33 and 24, as can be seen also in FIG. 3, are generally straight, flat, and parallel with respect to each other. The decks 31 and 32 define boundaries on the gaps 22 and 23, respectively. The deck 31 extends between the sides 33 and 34 and from the end 25 inward to the neck 20. Similarly, the deck 32 extends between the sides 33 and 34 and from the end 26 inward to the neck 20. The decks 31 and 32 are both very slightly curved. Turning very briefly to FIG. 2, which illustrates a side elevation view of the body 11 of the ring 10, the opposed decks appear to be flat and level with each other. However, the decks 31 and 32 are actually slightly inclined arcuately upward from the ends 25 and 26, respectively toward the neck 20. The rise of the decks 31 and 32 from the ends 25 and 26 to the neck 20 cooperates with the blade 13 to provide a desired angle of incision when a fishing line is cut with the ring 10.

Returning to FIG. 1, the decks 31 and 32 are each generally rectangular, defined by the straight sides 33 and 34, the straight ends 25 and 26, and the neck 20. The decks 31 and 32 have a width measured between the sides 33 and 34 which is generally constant from proximate to the ends 25 and 26, respectively, through to proximate to the neck 20. As shown in FIG. 2, the corners 35 are separated by a distance A, and the ends 25 and 26 are separated by a distance B which is just greater than the distance A.

Referring to FIG. 1, corners 35 and 36 are formed between the ends 25 and 26 and the decks 31 and 32, respectively. The corners 35 and 36 are rounded to provide a smooth, continuous junction from the ends 25 and 26 to the decks 31 and 32, respectively, and to provide a ramped entrance from the ends 25 and 26 into the gaps 22 and 23, respectively. Therefore, from the lower end 30, a continuous, smooth surface is presented including the end 25, the corner 35, and the deck 31. Similarly, from the lower end 30, a continuous, smooth surface is presented including the end 26, the corner 36, and the deck 32. In this way, a fishing line can be pulled smoothly against and along the end 25, the corner 35, and the deck 31 and into the gap 22. Similarly, a fishing line can be pulled smoothly against and along the end 26, the corner 36, and the deck 32 and into the gap 23. Moreover, the intersections between the transverse surfaces, namely the ends 25 and 26 the corners 35 and 36, and the decks 31 and 32, and the sides 33 and 34 are rounded as well. The portion of the body 11 between the deck 31, the end 25, and the underside 24 is defined as the shoulder 15. Similarly, the portion of the body 11 between the deck 32, the end 26, and the underside 24 is defined as the shoulder 16.

Between the shoulders 15 and 16, the neck 20 projects upwardly from the base 14. The neck 20 is a slender extension formed integrally to the base 14 as part of the body 10. The neck 20 has a width which is equal to the width between the sides 33 and 34. The neck 20 has a thickness C between the decks 31 and 32, as shown in FIG. 2. The neck 20 projects upwardly just a short distance from the decks 31 and 32 to the cap 21. The neck 20 thus separates the cap 21 from the base 14. In the embodiment shown in FIG. 2, the cap 21 is separated approximately 0.125 inches (0.318 centimeters) from the decks 31 and 32.

Referring to FIG. 2, the cap 21 is formed to the neck 20 and thus is integral to the body 11 entirely. The cap 21 both holds the blade 13 in position in the ring 10 and forms a protective cover for the blade 13 so that the fisherman cannot cut himself on the blade. The cap 21 has a generally dome-shaped form, including a curved top surface 40 and two opposed undersides 41 and 42. The underside 41 extends from the neck 20 to an end 43, and the underside 42 extends from the neck 20 to an end 44. The undersides 41 and 42 are spaced part by the neck 20. Referring to FIG. 1, proximate to the neck 20, the cap 21 has a width equal to that between the sides 33 and 34. However, the width of the cap 21 tapers, such that proximate to the ends 43 and 44, the width of the cap 21 reduces or converges to an intermediate location so that it is less than the distance between the sides 33 and 34. In this way, the cap 21 guides and forms a fishing line placed over the cap 21 into a loop which is ready to be sliced by the blade 13. Further, the top of the cap 21 is beveled: two beveled surfaces 37 and 38 extend downwardly from the top surface 40 to the sides 33 and 34, respectively. As seen in FIG. 3, the beveled surfaces 37 and 38 are aligned at roughly a 45-degree angle to the top surface 40 and to the sides 33 and 34, providing the ring 10 with a generally smooth, low-profile, and curved cap 21 which cannot be caught on clothing, gear, body parts, or other articles.

Referring now to FIG. 1, the cap 21 has opposed lobes 45 and 46 which project out laterally from the middle of the cap 21 and over the decks 31 and 32, respectively. The lobes 45 and 46 project out beyond the corners 35 and 36 of the base 14 but are recessed with respect to the base 14. The cap 21 has a distance D between the ends 43 and 44. This distance D is greater than the distance A between the corners 35 and 36, but is less than the distance B between the ends 25 and 26.

Figure 4:
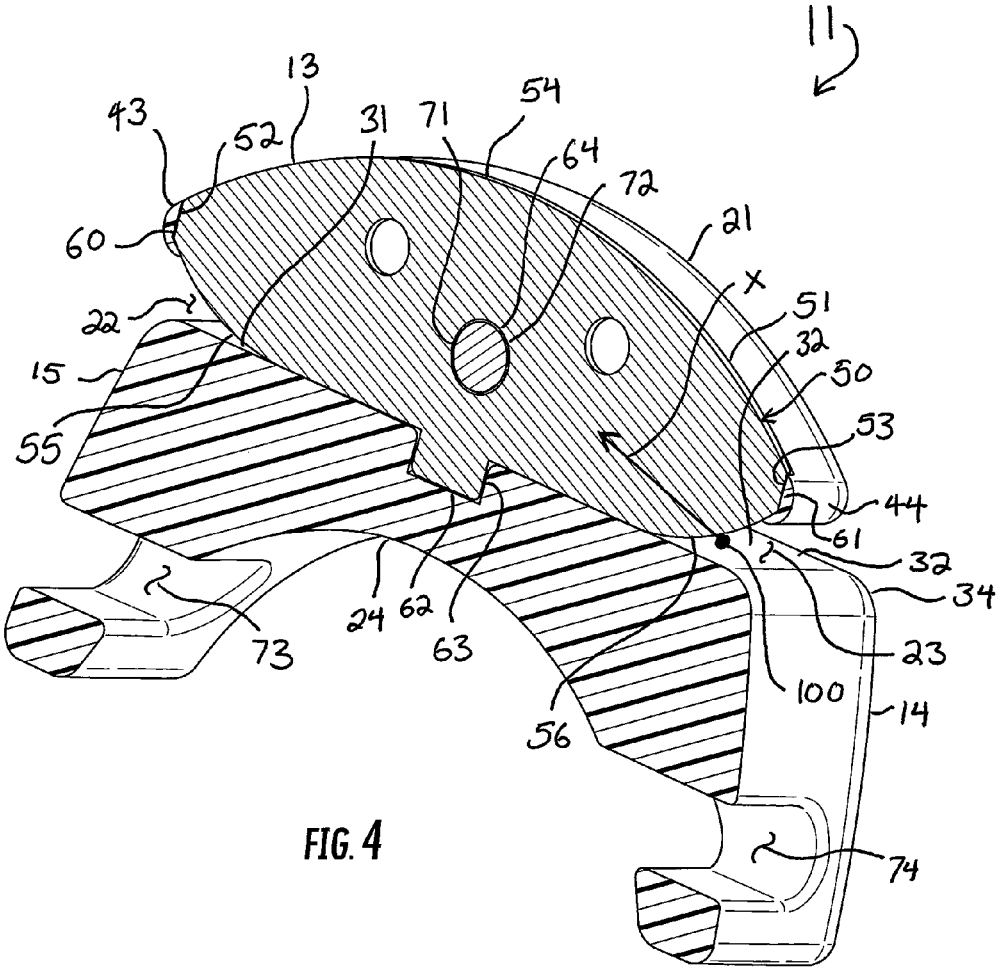
FIG. 4 is a perspective section view of the body and blade of the ring of FIG. 1 in isolation without the strap, taken along the line 4-4 in FIG. 1.

Bisecting the cap 21 and stretching nearly between the ends 43 and 44 is a slit 50 into which the blade 13 is seated and held securely. The slit 50 is arranged along an axis E which is transverse to an axis F extending centrally through opening formed by the body 11 and the strap 12 which receives a finger. The axis E is an axis of symmetry for the ring 10. The slit 50 has a curved opening 51 whose curvature corresponds to the curved top surface 40 of the cap 21. The opening 51 leads into the slit 50 and provides access thereto, and the opening 51 spans substantially the entire dimension of the cap 21 along the axis E. The opening 51 ends just short of the ends 43 and 44. As seen in FIG. 4, which is a section view taken along the line 4-4 in FIG. 1 showing the body 11 in isolation, the extent of the opening 51 and the slit 50 can be seen. The entirety of the cap 21 is bisected by the slit 50 but for small tabs 52 and 53 at the ends 43 and 44, respectively. Each of the tabs 52 and 53 is a roughly semi-cylindrical structure which connects a left half of the cap 21 to a right half of the cap 21, thereby maintaining the cap 21 as an integral and rigid structure. The tabs 52 and receive the blade 13 in a press-fit engagement snugly between the tabs 52 and 53 and prevent lateral movement along the axis E. The slit 50 has an open bottom, not shown in FIG. 4 because it is concealed by the blade 13. However, the open bottom is open through the undersides 41 and 42 of the cap 21. In this way, the blade 13 occupies nearly the entirety of the cap 21 and further depends into the gaps 22 and 23 between the cap 21 and the base 14, so that it is exposed at the gaps 22 and 23. Even still, the blade 13 is recessed within the gaps 22 and 23, is recessed away from the ends 43 and 44, and is recessed away from the sides 33 and 34. The approximately 0.125 inches (0.318 centimeters) by which the cap 21 is spaced apart from the decks 31 and 32 is sufficiently small, and the blade 13 is set back from the ends 43 and 44 and the sides 33 and 34 a sufficient distance that a finger cannot be introduced deep enough into either of the gaps 22 and 23 from any direction to contact the blade. In other words, the blade 13 is disposed inboard from the sides 33 and 34 and from the ends 25 and 26 such that the sides 33 and 34 and the ends 25 and 26 prevent an object larger than the gaps 22 and 23 from touching the blade 13. In this way, the blade 13 cannot inadvertently cut the fisherman or anyone else.

The blade 13 is sized and shaped to fit securely in the ring 10 to prevent accidental dislodgment. The blade 13 is illustrated best in FIG. 4. There, it can be seen that the blade 13 has a curved upper edge 54 which is dull, and curved lower edges 55 and 56 which are sharpened, preferably with a single chisel grind (best seen in FIG. 3). As the term is used herein, a "single chisel grind," or simply "chisel grind" means the blade 13 is beveled on one side only. The single chisel grind is extremely sharp and produces no drag on the fishing line as it is passed over either of the curved lower edges 55 or 56 because the line does not interact with and become caught on a flat portion of the edge. Further, the single chisel grind provides increased strength and rigidity compared to other types of edge profiles such as a flat grind, saber grind, or double chisel grind. The upper edge 54 meets the curved lower edges 55 and 56 at ends 60 and 61, respectively, of the blade 13. The ends 60 and 61 are blunt and transverse with respect to both the upper edge 54 and the curved lower edges 55 and 56, respectively. During assembly, the ends 60 and 61 of the blade 13 are preferably heated during application of the blade 13 into the slit 50, so that when the blade 13 is seated into the slit 50, the heated ends 60 and 61 cause the tabs 52 and 53 formed at the ends 43 and 44, respectively, of the cap 21 to melt and deform, thereby causing the tabs 52 to 53 to mold and form around the blade 13, further securing the blade 13 in the slit 50.

Still referring to FIG. 4, the curved lower edge 55 has a convex curve. Proximate to the end 60, the curved lower edge 55 is curved upwardly, transverse to the deck 31. The curve of the curved lower edge 55 decreases from proximate to the end 60, until the curve is level and flush with the deck 31 proximate to the neck 20. In other words, proximate to the neck 20, the curved lower edge 55 is parallel to the deck 31 and in contact with the deck 31. In yet still other words, a normal line projecting outward from the curved lower edge 55 changes orientation from the end 60 to the neck 20, from an orientation transverse to the deck 31 to an orientation perpendicular to the deck 31. In this way, the curved lower edge 55 ramps downward from the end 43 of the cap 21 into contact with the deck 31 and the shoulder 15, such that a fishing line pulled against the blade 13 will ride along the curved lower edge 55 until it is either cut or pulled into the decreasing angle formed between the deck 31 and the curved lower edge 55 proximate to the neck 20, where the fishing line is forced into contact with and against the curved lower edge 55. This shape effects a cutting action achieved by the simultaneous cutting and sliding of the line along the curved lower edge 55, which provides a smoother, cleaner cut than can be achieved by a straight-edged blade. Straight-edged blades, such as many knives, cut a line by chopping the line. Other straight-edged blades, such as scissors, cut a line by crimping or biting the line between two sharpened jaws: the line is cut into while remaining stationary along the blade. In contrast, the curved lower edge 55 of the blade 13 cuts increasingly deeper into the line as the line is pulled along the curved lower edge 55.

The curved lower edge 56 is structured and arranged similarly. Again, and with reference still to FIG. 4, the curve of the curved lower edge 56 is convex and decreases from proximate to the end 61, until the curve is level and flush with the deck 32 proximately to the neck 20. In other words, proximate to the neck 20, the curved lower edge 56 is parallel to the deck 32 and in contact with the deck 32. In yet still other words, a normal line projecting outward from the curved lower edge 56 changes orientation from the end 61 to the neck 20, from an orientation transverse to the deck 32 to an orientation perpendicular to the deck 32. In this way, the curved lower edge 56 ramps downward from the end 44 of the cap 21 into contact with the deck 32, such that a fishing line pulled against the blade 13 will ride along the curved lower edge 56 until it is either cut or pulled into the decreasing angle formed between the deck 32 and the curved lower edge 56 proximate to the neck 20, where the fishing line is forced into contact with and against the curved lower edge 56. This shape effects a cutting action achieved by the simultaneous cutting and sliding of the line along the curved lower edge 56. The curved lower edge 56 of the ring 10 cuts increasingly deeper into the line as the line is pulled along the curved lower edge 56. FIG. 4 illustrates a line 100 being drawn along the curved lower edge 56 (the line 100 has been enlarged as a solid round mark to render it visible; this enlargement is not intended to be limiting but rather only explanatory). The line 100 is being pulled from the end 61 toward the neck 20. The line 100 is taut against the blade 13 because of the force being applied one the line 100 by the fisherman. This force is directed along a vector illustrated as the arrowed line X in FIG. 4. The line X is oriented in the same direction throughout movement of the line 100 from the end 61 toward the neck 20. However, the angle of the curved lower edge 56 changes from the end 61 to the neck 20, such that a relative angle formed between the curved lower edge 56 and the line X changes from the end 61 to the neck 20, namely, the line X increasingly conforms to the orientation of the curved lower edge 56 from the end 61 to the neck 20. This narrowing of the relative angle produces a clean slice of the line 100 not achieved with blades of other arrangements. Further, as the relative angle approaches zero, the line 100 becomes bound between the curved lower edge 56 and the deck 32, further forcing the line 100 into the curved lower edge 56. It should be understood that the same cutting action occurs at the curved lower edge 55 and its description with respect to the curved lower edge 56 is equally applicable to the curved lower edge 55.

The curved lower edges 55 and 56 are discontinuous with each other. The curved lower edges 55 and 56 are separated by a downwardly-extending tooth 62 located at a generally intermediate location between the ends 60 and 61. The tooth is a rectangular projection, formed between the curved lower edges 55 and 56, which extends downwardly a short distance. The tooth 62 is blunt. The tooth 62 is fit into a socket 63 sized and shaped to snugly receive the tooth 62 therein. As seen most easily in FIG. 5, which is a section view taken along the line 5-5 in FIG. 1, the socket 63 is an extension of the slit 50. Whereas the slit 50 ends at the undersides 41 and 42 of the cap 21, the socket 63 extends through the neck 20 below the undersides 41 and 42 and below the decks 31 and 32. The socket 63 extends approximately one-third the distance between the decks 31 and 32 and the underside 24 of the base 14, as shown in FIG. 4. The tooth 62, received snugly in the socket 63, limits lateral movement of the blade 13 along the axis E.

Figure 5:
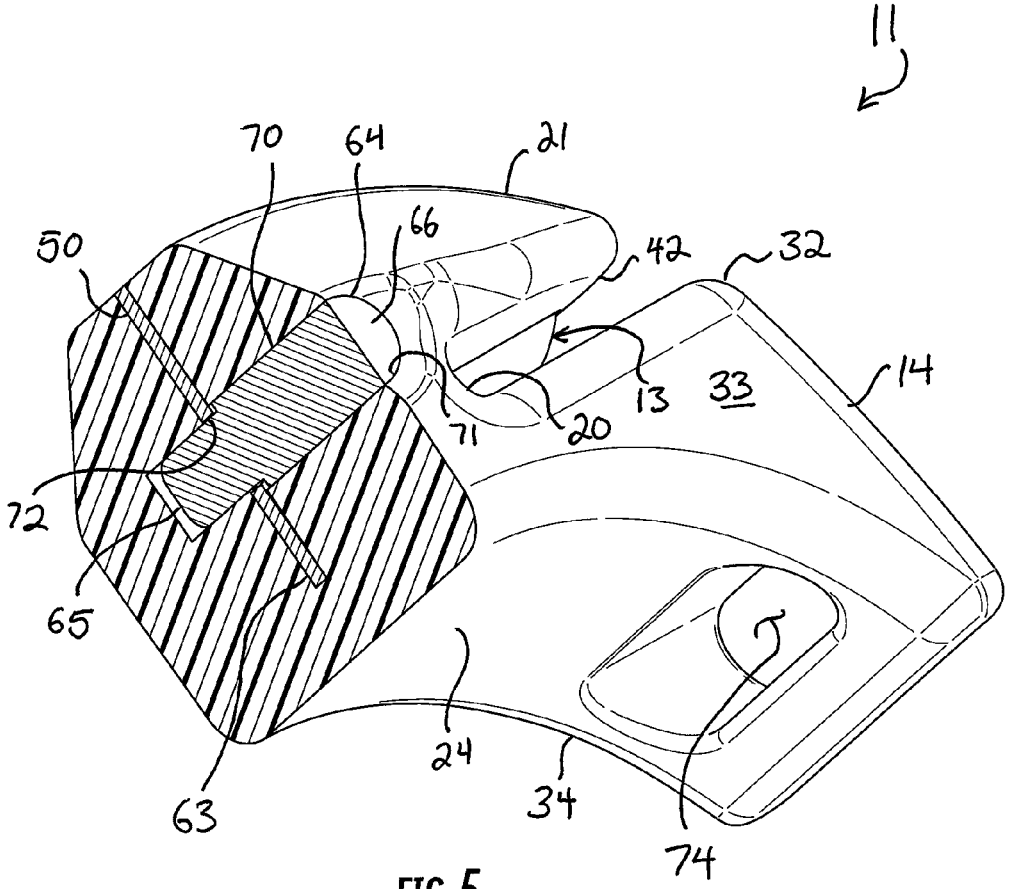
FIG. 5 is a perspective section view of the body and blade of the ring of FIG. 1 in isolation without the strap, taken along the line 5-5 in FIG. 1.

Further securing the blade 13 is a pin 64 pressed through the blade 13 and the cap 21. The pin 64 is most clearly illustrated in FIGS. 4 and 5. The pin 64 has a distal end 65, an opposed proximal end 66, and a shank 70 extending therebetween. The pin 64 is fit into a bore 71 formed through the neck 20 and the cap 21. The bore 71 has a first diameter proximate to the side 33 of the body 11 and a second diameter proximate to the side 34 of the body 11 which is less than the first diameter. The bore 71 decreases from the first diameter to the second diameter at the slit 50, as shown in FIG. 5. The pin 64 has a corresponding shape: the pin 64 has a first diameter proximate to the proximal end 66 and a second diameter proximate to the distal end 65 which is less than the second diameter. The first diameters of the pin 64 and the bore 71 correspond, and the second diameter of the pin 64 and the bore 71 correspond, so that the pin 64 is press-fit into the bore 71 to secure the pin 64 in the bore 71. The blade 13 is formed with a hole 72 corresponding in size to the bore 71. When the blade 13 is properly seated in the slit 51, the hole 72 is registered with the bore 71, so that the pin 64 may be fit through the bore 71 and the hole 72, thereby engaging the blade 13 still further in the body 11. With the pin 64 through the bore 71 and the hole 72, the press-fit engagement of the blade 13 in the slit 51, the tooth 62 received in the socket 63, and the thermal deformation of the tabs 52 and 53, the blade 13 is secured in the body 11 in various strong and reliable manners, such that the blade 13 is prevented from lateral movement along the axis E and upward movement out of the opening 51 of the slit 50. It is noted that the blade 13 is prevented from lateral movement along the axis F by interaction with the cap 21, as the slit 50 corresponds in width to the blade 13 and receives the blade in a snug-fit engagement.

The ring 10 is mounted for wear on a fisherman's finger. Returning to FIG. 1, the strap 12 is shown. The strap 12 is a length of flexible, strong material, such as nylon. The strap 12 has a closed loop 80 formed by a length of the strap 12 secured onto itself at one end of the strap 12. The length is looped through a large slot 73 proximate to the lower end 30 and the end 25 of the base 14 and then fastened upon itself with a fastener such as a rivet, snap closure, or other like fastener. A free end 81 is looped through a large slot 74 opposed to the other slot 73. The large slot 74 is formed through the end 26 proximate to the lower end 30 of the base 14. The free end 81 is adjustable. The strap 12 has a face carrying a hook-and-loop engagement assembly consisting of hook elements 82 and loop elements 83, so that when the free end 81 is passed through the slot 74 and looped back upon itself, the hook elements 82 are opposed from the loop elements 83, and the free end 81 can be fastened, thereby setting the strap 81 to a fixed length. The strap 12, together with the underside 24 of the base 14, define a circular opening 84 through which the fisherman's finger is applied along the axis F.

The strap 12 is adjusted to fit the fisherman's finger tightly. The ring 10 is preferably worn so that the blade 13 is positioned on the dorsal side of the fisherman's hand. The ring 10 could be worn so that the blade 13 is on the palmar side of the hand, but this may be less comfortable for some fishermen. The ring 10 is useful for cutting heavy braid or monofilament fishing line. When he desires to cut a fishing line, the fisherman grabs the fishing line with his other hand and forms a loop with the line, holding two portions of the line together to form a loop extending outward from his hold. The loop is fed into one of the gaps 22 and 23, and the fisherman pulls his hands apart from each other, such that the fishing line is pulled over one of the curved lower edges 55 and 56, either cutting the line immediately or being pulled into confrontation with one of the decks 31 and 32 and then into the curved lower edges 55 and 56 to be cut. In this way, the fisherman can quickly and easily cut a fishing line without having to remove and expose his knife. The ring 10 allows the fisherman to keep a cutting blade covered so that it does not pose a cutting risk to himself or others. When the blade 13 becomes dull, the ring 10 is simply discarded and replaced with a new ring 10.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A ring comprising:

a ring body including a shoulder, a neck extending from the shoulder, and a cap extending from the neck and spaced apart from the shoulder, thereby defining a gap between the cap and the shoulder;

a blade mounted in the cap and the neck;

the shoulder has a deck at a top of the shoulder;

the blade has a curved edge extending from the cap to the shoulder, into the gap, and along and in contact with the shoulder proximate to the neck the curved edge of the blade has an inner end proximate to the neck and an opposed outer end away from the neck;

the curved edge of the blade at the inner end is parallel to the deck; and the curved edge of the blade at the outer end is transverse with respect to the deck.

2. The ring of claim 1, wherein the deck of the shoulder rises toward the curved edge of the blade from proximate to the outer end of the curved edge of the blade to proximate to the inner end of the curved edge of the blade, in opposition to the curved edge of the blade.

3. The ring of claim 1, wherein:

the cap has an end extending away from the neck;

the deck has an end extending away from the neck; and the end of the cap extends further away from the neck than the end of the deck extends away from the neck.

4. The ring of claim 3, wherein:

the blade has an end extending away from the neck;

the end of the blade is inboard with respect to the end of the cap; and the end of the blade is seated into the end of the cap.

5. The ring of claim 1, further comprising:

the shoulder and the cap each have opposed sides; and proximate to an end of the cap, the sides of the cap converge to intermediate locations with respect to the sides of the shoulder.

6. The ring of claim 5, wherein the end of the cap is blunt.

7. The ring of claim 1, wherein the curved edge of the blade has a chisel grind.

8. The ring of claim 1, further comprising:

a slot formed in the cap; and the blade is mounted in the slot in a press-fit engagement.

9. The ring of claim 8, wherein:

the ring body includes a socket depending from the slot; and the blade has a depending tooth fit into the socket.

10. The ring of claim 1, further comprising:

a first axis along which the ring is configured to be worn;

a second axis along which the blade extends; and the first and second axes are transverse with respect to each other.

11. The ring of claim 1, further comprising a flexible strap coupled to the ring body and cooperating with the ring body to define a receiving space for receiving a finger therein.

12. The ring of claim 1, further comprising:

a bore formed through the cap;

a hole formed through the blade;

when the blade is received in the cap, the hole in the blade is registered with the bore in the cap; and a pin is press fit through the bore and the hole.

* * * * *